US007461496B2

(12) United States Patent
Hasselbach et al.

(10) Patent No.: US 7,461,496 B2
(45) Date of Patent: Dec. 9, 2008

(54) LOW PROFILE PACKAGING ASSEMBLY FOR LOOSE FILL INSULATION MATERIAL

(75) Inventors: John C. Hasselbach, Granville, OH (US); Michael E. Evans, Granville, OH (US)

(73) Assignee: Owens Corning Intellectual Capital, LLCDE (US)

( * ) Notice: Subject to any disclaimer, the term of this patent is extended or adjusted under 35 U.S.C. 154(b) by 344 days.

(21) Appl. No.: 11/350,369

(22) Filed: Feb. 8, 2006

(65) Prior Publication Data

US 2007/0193224 A1 Aug. 23, 2007

Related U.S. Application Data

(62) Division of application No. 11/350,216, filed on Feb. 8, 2006.

(51) Int. Cl.

| | |
|---|---|
| ***B65B 63/02*** | (2006.01) |
| ***B65B 13/20*** | (2006.01) |
| ***B65B 1/24*** | (2006.01) |
| ***B30B 1/00*** | (2006.01) |
| ***B30B 15/32*** | (2006.01) |

(52) U.S. Cl. ..... 53/529; 53/111 R; 53/436; 100/188 R; 100/218

(58) Field of Classification Search ..... 53/428, 53/436, 437, 432, 111 R, 510, 528, 527, 529; 100/188 R, 189, 215, 218, 232, 233, 250
See application file for complete search history.

(56) References Cited

U.S. PATENT DOCUMENTS

| | | | | | |
|---|---|---|---|---|---|
| 801,963 | A | * | 10/1905 | Beaty | 100/90 |
| 3,382,643 | A | * | 5/1968 | Hullhorst et al. | 53/434 |
| 3,499,261 | A | * | 3/1970 | Hullhorst et al. | 53/430 |
| 3,685,437 | A | * | 8/1972 | Panning | 100/45 |
| 3,691,944 | A | * | 9/1972 | Boyd | 100/229 A |
| 3,714,890 | A | * | 2/1973 | Moon | 100/229 A |
| 3,861,117 | A | * | 1/1975 | DeFilippi | 53/527 |
| 4,162,603 | A | * | 7/1979 | Stromberg | 53/438 |
| 4,183,295 | A | * | 1/1980 | Peterson | 100/345 |
| 4,601,238 | A | * | 7/1986 | Davis et al. | 100/45 |
| 4,896,593 | A | * | 1/1990 | Slusser | 100/345 |
| 5,029,522 | A | * | 7/1991 | Brisson | 100/233 |
| 5,343,670 | A | * | 9/1994 | Gombos et al. | 53/399 |
| 5,987,858 | A | * | 11/1999 | Long | 53/529 |
| 6,158,336 | A | * | 12/2000 | Cambiano | 100/345 |
| 2007/0180797 | A1 | * | 8/2007 | Hasselbach et al. | 53/527 |

* cited by examiner

*Primary Examiner*—Paul R Durand
(74) *Attorney, Agent, or Firm*—James J. Dottavio

(57) ABSTRACT

A packaging assembly for insulation material has a compression chamber and a surge hopper vertically mounted above the compression chamber. An air drawing assembly positioned beneath the compression chamber draws air through the surge hopper and the compression chamber.

20 Claims, 7 Drawing Sheets

LOW PROFILE PACKAGING ASSEMBLY FOR LOOSE FILL INSULATION MATERIAL

TECHNICAL FIELD AND INDUSTRIAL APPLICABILITY

This invention relates generally to packaging of loose fill insulation materials.

BACKGROUND OF THE INVENTION

Packaging loose fill fibrous insulation materials typically involves a bagging system that uses multiple pieces of fiber handling equipment. The multiple-piece bagging system often includes equipment to: separate the insulation materials into loose, air-entrained quantities of insulation material; weigh the insulation materials; compress the insulation materials; and, finally, package the compressed insulation materials.

In the past, the multi-step bagging system had extreme height requirements in order to be able to transfer the insulation materials from one processing step to the next. The bagger system typically had four platform levels and the baggers often reached heights of about sixty-five feet. The heights of such bagger system required major installation concerns, often requiring that the roofs be extended.

During the operation of such bagger systems, when the insulation material was transferred from one step to the next, the insulation material fell into an uneven distribution. Often, insulation materials would fall into peaked mounds. When these peaked mounds of insulation material were compressed into a package, the compressed mounds had an uneven distribution, or density, of insulation materials within the package. Such compressed packages often had more fibers in the middle of the package, than at the edges.

Also, the uneven compression of the insulation material sometimes caused damage to the insulation materials themselves. Thus, the subsequent use of such packaged insulation material by an end user was made more difficult.

SUMMARY OF THE INVENTION

A packaging assembly for packaging loose fill insulation material into a compressed package includes an insulation material separator for substantially evenly distributing a stream of the loose fill insulation material.

A surge hopper assembly receives the substantially evenly distributed insulation material from the separator assembly, temporarily collects the substantially evenly distributed insulation material, and subsequently disperses the insulation material.

A compression assembly receives the substantially evenly dispersed supply of insulation material from the surge hopper assembly and compresses the insulation material in a substantially uniform manner.

An air drawing assembly vertically draws air from the supply of the loose fill insulation material in the surge hopper assembly and the compression assembly.

Also, in certain embodiments, a weigh hopper is positioned in communication with the surge hopper assembly and the compression assembly. The weigh hopper receives the substantially evenly dispersed insulation material from the surge hopper assembly; weighs the supply of substantially evenly dispersed insulation material; and Delivers a weighed supply of the insulation material to the compression assembly.

Various objects and advantages of this invention will become apparent to those skilled in the art from the following detailed description of the preferred embodiment, when read in light of the accompanying drawings.

DETAILED DESCRIPTION OF THE INVENTION

A low-profile packaging assembly 10 as shown is especially useful to compress and then package desired quantities of loose fill insulation material into substantially evenly compressed packages. The low-profile packaging assembly 10 requires only a fraction of the vertical manufacturing work space that prior bagger systems required.

Figure 1A:
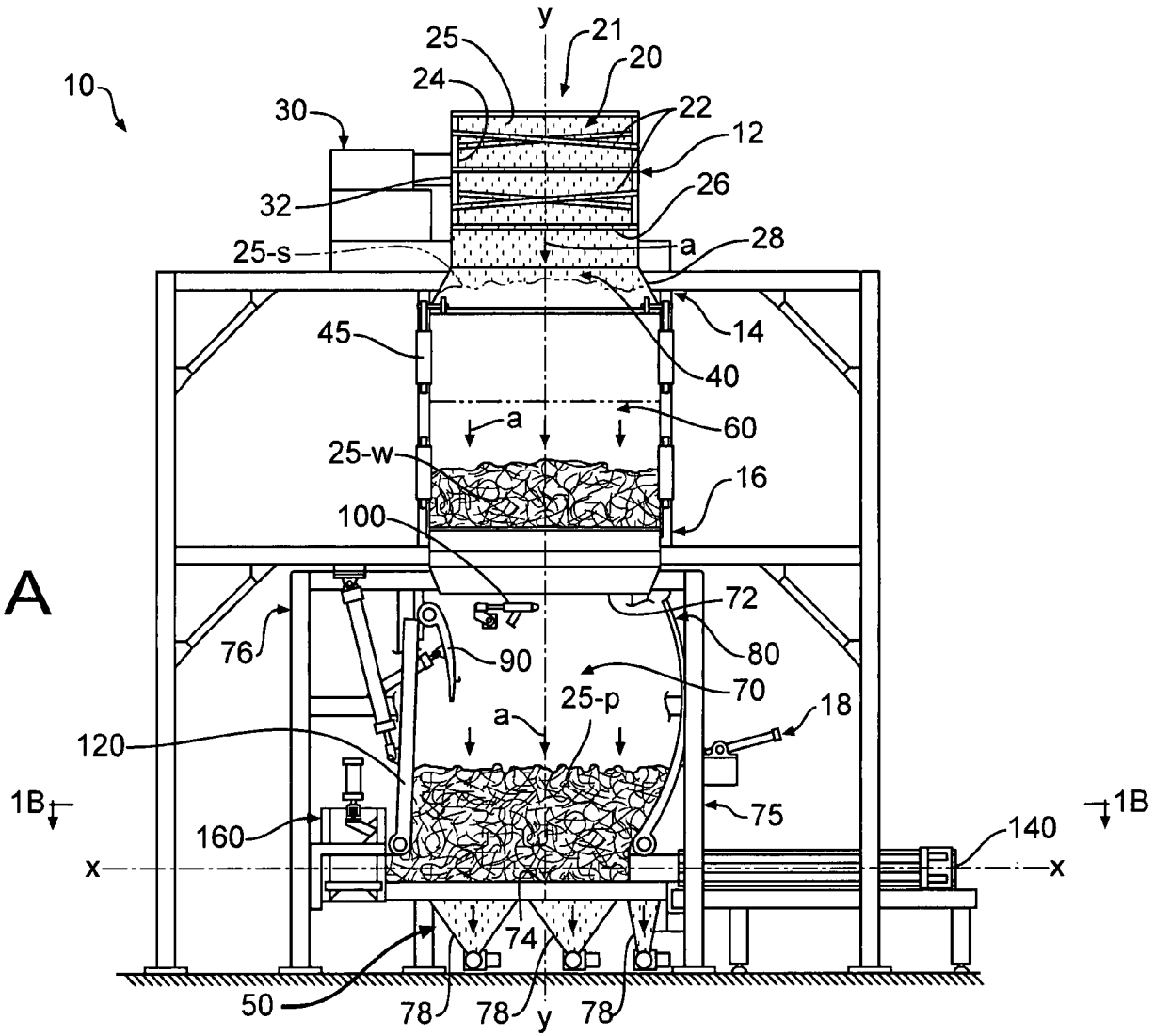
FIG. 1A is a schematic illustration showing a cross-sectional view in elevation, partially in phantom, of a packaging assembly having supplies of the loose fill insulation material substantially evenly dispersed therein.

Referring now to FIG. 1A, in certain embodiments, the low-profile packaging assembly 10 includes a rotary separator assembly 12; a surge hopper assembly 14; a weigh hopper assembly 16; a compression assembly 18; and, a single source 50 for withdrawing air from the packaging assembly 10.

The rotary separator assembly 12 includes a separator chamber 20 having a separator drum 21 which rotates one or more longitudinally oriented baffles 22. The separator chamber 20 has a first opening 24 for receiving a supply of the loose fill insulation material 25. The separator chamber 20 has an elongated bottom opening 26. In certain embodiments, the bottom opening 26 is positioned above a funnel connector 28 which, in turn, is positioned above the surge hopper assembly 14. In embodiments where the packaging assembly 10 does not include the funnel connector 28, the bottom opening 26 of the separator chamber 20 is directly positioned above the surge hopper assembly 14.

The rotary separator assembly 12 also includes an air-entraining device 30 for introducing a desired volume of air through an air inlet duct 32 into the separator chamber 20. The separator drum 21 is rotated to entrain, or mix, the air into the insulation material 25 and to separate, or fluff, the adjacent insulation materials 25. The air-to-fiber ratio can be adjusted, depending on the type of fibers being packaged, the packaging rate of the insulation materials, and other such parameters.

In certain embodiments, the air inlet duct 32 is configured to allow the volume of air to be delivered into the separator drum 21 at a point substantially immediately adjacent to the opening 24 where the insulation materials 25 are being introduced into the separator chamber 20. In certain embodiments, the air inlet duct 32 is within about 1 to about 3 inches from the insulation material opening 24 in the separator drum 21.

The rotary separator chamber 20 has desired length and width perimeter dimensions such that the insulation material 25 is substantially evenly distributed as a stream of insulation material to the surge hopper assembly 14. In certain embodiments, the rotary separator chamber 20 has an elongated length-to-width perimeter ratio which provides a generally level or low dispersion profile of insulation materials, as is further explained below. In certain embodiments, the length-to-width perimeter ratio of the separator chamber 21 is about 5 to about 3, providing a ratio of 0.60 (width divided by length). In other embodiments, the ratio is less than 0.8.

The packaging assembly 10 can optionally include a weigh hopper assembly 16. The following explanation will discuss the progress of the insulation materials 25 through the packaging assembly 10 where the insulation materials 25 are collected by the surge hopper assembly 14, weighed by the weigh hopper assembly 16, and dispersed into the compression assembly 18. It should be understood, however, that in certain embodiments, a pull rate timing system (not shown) can also be used to eliminate the weigh hopper assembly 16 if an additional height-reduction is required for the packaging assembly 10. In such embodiments, the insulation materials 25 are first collected by the surge hopper assembly 14 and then directly delivered to the compression assembly 18. Under other operating conditions as shown in the figures herein, however, the insulation materials 25 are first dispersed into the surge hopper assembly 14 where they are dispersed into the weigh hopper assembly 16, and finally dispersed into the compression assembly 18.

Figure 1B:
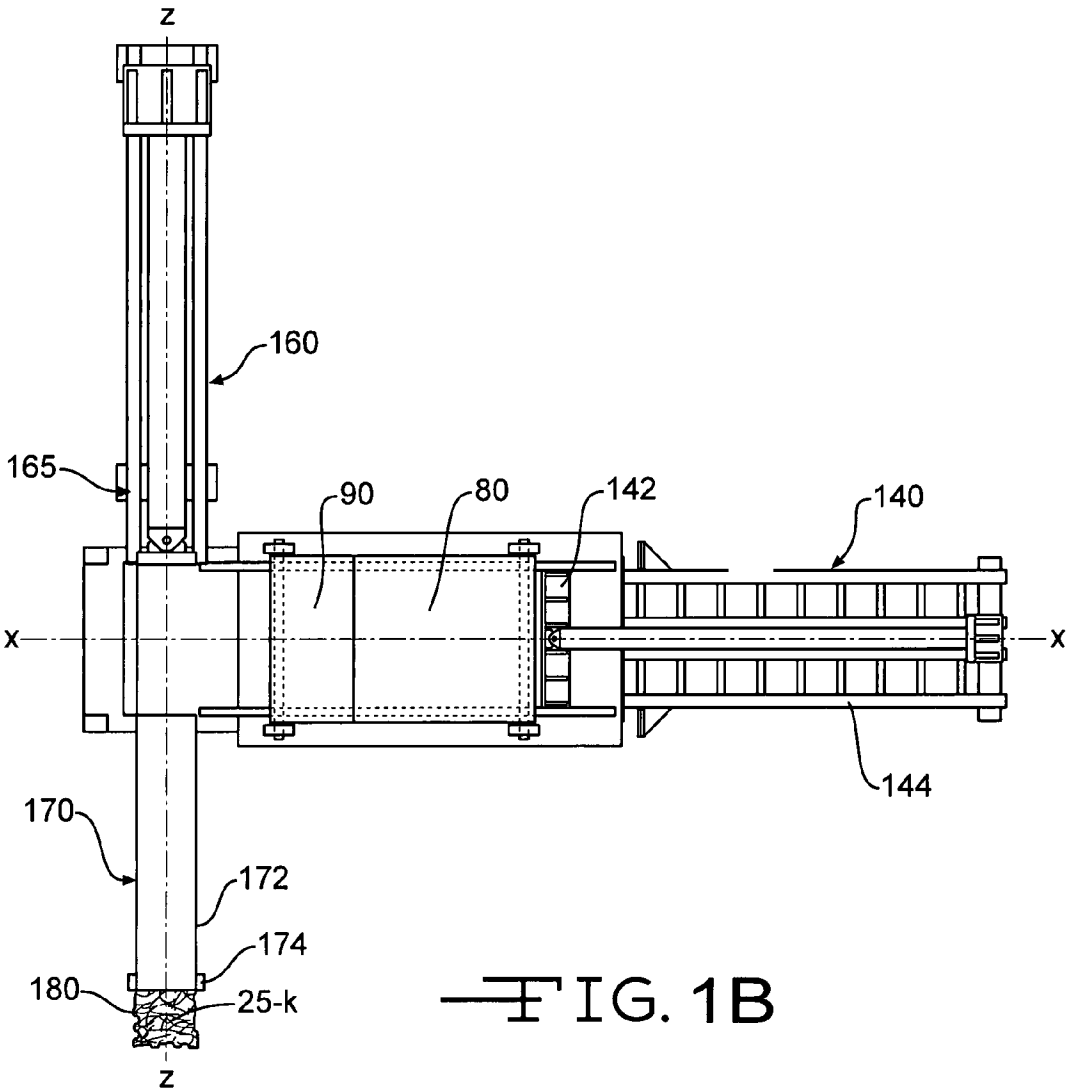
FIG. 1B is a schematic plan view taken along the line 1B-1B in FIG. 1A showing a compression assembly, a ramming assembly and a bagging assembly of the packaging assembly.
Figure 1C:
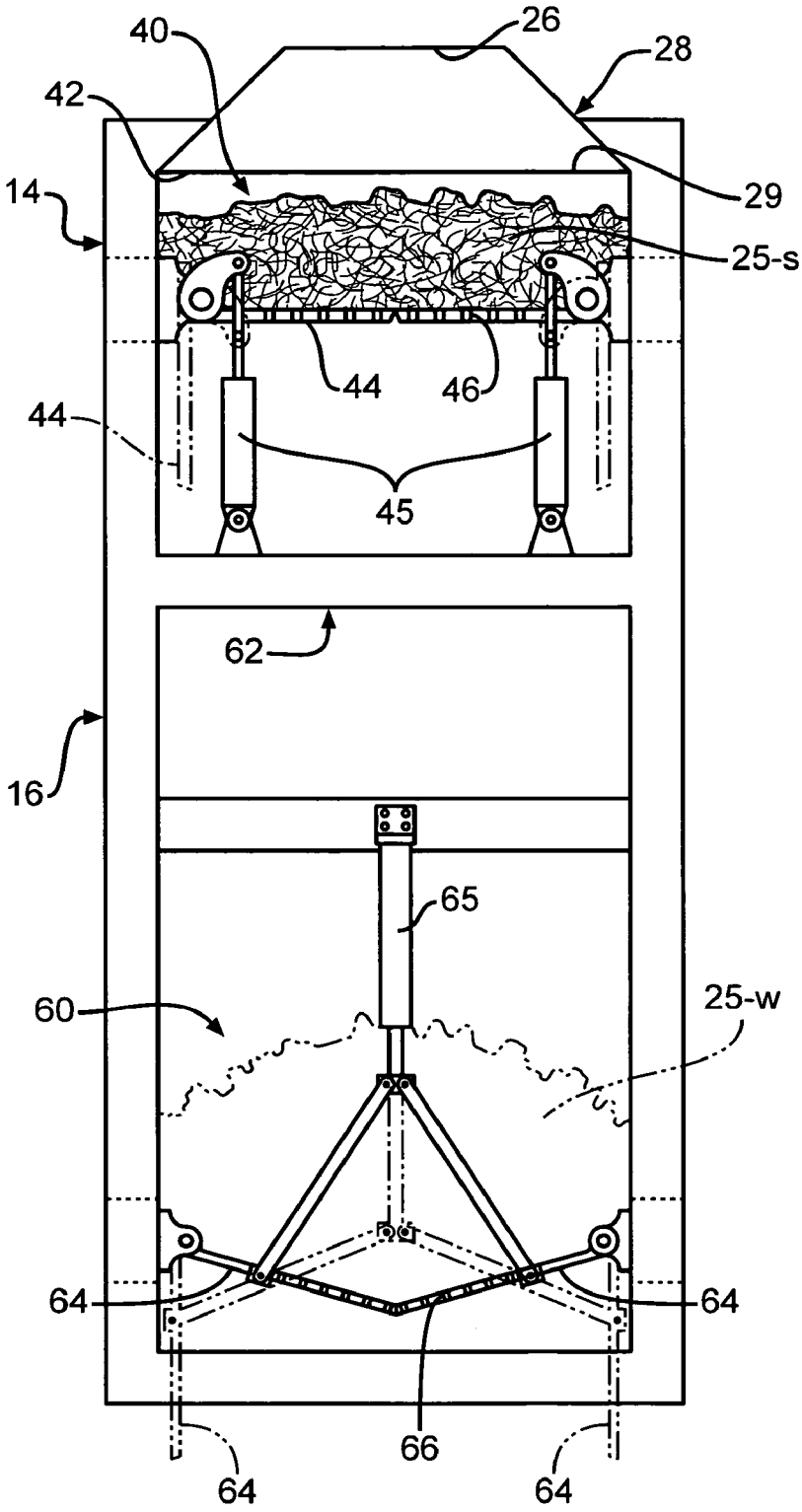
FIG. 1C is a schematic illustration showing a side view of a surge hopper assembly and a weigh hopper assembly of the packaging assembly shown in FIG. 1A.

As best seen in FIG. 1C, the surge hopper assembly 14 defines a surge chamber 40 that includes an upper opening 42 and a pair of opposing bottom surge hopper doors 44. In certain embodiments, the rotary separator bottom opening 26 has substantially the same elongated perimeter dimensions as the upper opening 42 of the surge hopper assembly 14.

In other embodiments, the bottom opening 26 of the rotary separator assembly 12 can be connected to the inverted funnel connector 28, which, in turn, is connected to the surge hopper assembly 14. In such embodiments, the inverted funnel connector 28 gradually widens such that a bottom of the funnel 28 and the upper opening 42 of the surge hopper assembly 14 have substantially the same elongated perimeter dimensions.

The distribution of the stream of the insulation materials 25 dispersed from the rotary separator assembly 12 into the surge hopper assembly 14 is controlled, at least in part, by the volume and speed of air being introduced into the insulation materials 25 within the separator chamber 20 of the rotary separator assembly 12 and by the volume of air being drawn through the packaging assembly 10 by the air-withdrawing source 50, as further explained below.

The elongated perimeter dimensions of the bottom opening 26 of the rotary separator assembly 12 and the elongated perimeter dimensions of the upper opening 42 of the surge hopper assembly 14 allow for a relatively "low-profile" surge hopper body 25-*s* of insulation materials 25 to accumulate on the closed bottom surge hopper doors 44 of the surge hopper assembly 14.

The term "low-profile" is generally to be understood herein as defining a body of insulation material having a relative uniform and level height distribution (i.e., a flattened plateau-like shape rather than a peaked shape). In certain embodiments, the ratio of the height of the body at its highest point to the height of the low-profile body at its lowest point of the low-profile body is no greater than about 1.2 to 1, and in other embodiments, about 1.1 to 1. In certain embodiments, the cross-sectional dimension of the low-profile body of insulation material is generally rectangular, rather than parabolic or triangular (i.e., peaked mounds).

Since a relatively low-profile height of the surge hopper body 25-*s* of insulation materials 25 is dispersed into the surge hopper chamber 40, the surge hopper assembly 14 can be made with desired shorter height dimensions, as compared to prior insulation material bagging assemblies.

Referring again to FIGS. 1A and 1C, the surge hopper doors 44 extend substantially along the length and width of the surge hopper chamber 40. Each surge hopper door 44 is operatively connected respectively to a pneumatic actuator 45. In certain embodiments, the surge hopper doors 44 have a plurality of perforations 46 to allow air to be drawn through the surge hopper assembly 14, as will be further described below.

Each surge hopper door 44 has a long side 47 and a short side 48, as best seen in FIGS. 1A and 1C, respectively. Each surge hopper door 44 is pivotably mounted on the long side 47 so that the short side 48 pivots open in a downward direction, as shown in phantom in FIG. 1C. Since the short side 48 of the surge hopper door 44 is the side that pivots, the surge hopper chamber 40 has reduced height requirements. While the doors 44 are closed, the drawn air moving through the surge hopper chamber 40 pulls the insulation material against the surge hopper doors 44, causing the body 25-*s* of insulation material to spread along the surge hopper doors 44. Since the drawn air tends to seek the path of least resistance through the accumulating insulation material, drawn air pulls or moves and spreads out the insulation material so that the insulation material thus accumulates into the desired low-profile insulation material body 25-*s*.

When the actuators 45 pivot the surge hopper doors 44 downwardly into the opened position, the insulation material comprising the surge hopper body 25-*s* is then generally evenly dispersed into the weigh hopper assembly 16, as schematically shown in FIGS. 1A and 1C. The short sides 48 also allow for a rapid dispersion of the insulation material and allow for the insulation material to be substantially uniformly spread out along the length of the weigh hopper chamber 60.

The weigh hopper assembly 16 defines a weigh chamber 60 that has an upper opening 62 and a pair of opposing bottom weigh hopper doors 64. In certain embodiments, the weigh hopper upper opening 62 has at least the same length and width dimensions as the surge hopper assembly 14. Thus, the surge hopper body 25-*s* of insulation material 25 is dispersed from the opening surge hopper doors 44 through the weigh hopper opening 62 and onto the weigh hopper doors 64.

The falling insulation materials 25 then re-accumulate as a low-profile weigh hopper body, shown as 25-*w*, within the weigh hopper assembly 16. In certain embodiments, the weigh hopper doors 64 have a plurality of perforations 66 to allow air to be drawn through the weigh hopper assembly 16 to the compression assembly 18 below, as further described below.

Each weigh hopper door 64 has a long side 67 and a short side 68, as best seen in FIGS. 1A and 1C, respectively. Each weigh surge hopper door 64 is pivotably mounted on the long side 67 so that the short side 68 pivots open in a downward direction, as shown in phantom in FIG. 1C. Since the short side 68 of the weigh hopper door 64 is the side that pivots, the weigh hopper chamber 60 has reduced height requirements. While the doors 64 are closed, the drawn air moving through the weigh hopper chamber 60 pulls the insulation material against the weigh hopper doors 64, causing the body 25-*w* of the insulation material to substantially be spread along the weigh hopper doors 64. Again, since the drawn air tends to seek the path of least resistance through the accumulating insulation material, the insulation material thus accumulates into the desired low-profile insulation material body 25-*w*.

When the actuators 65 pivot the weigh hopper doors 64 downwardly into the open position, the insulation materials comprising the weigh hopper body 25-*w* are then generally evenly dispersed into the compression assembly 18, as schematically shown in FIG. 1A and FIGS. 2A-2C. The short side walls 68 also allow for a rapid dispersion of the insulation material and allow the insulation material to be substantially uniformly spread out along the length of the compression chamber 70.

When the weigh hopper doors 64 are opened, the accumulated insulation material within the weigh hopper body 25-*w* is again dispersed and then accumulated into a pre-compressed insulation material body 25-*p* within the compression assembly 18.

Figure 2A:
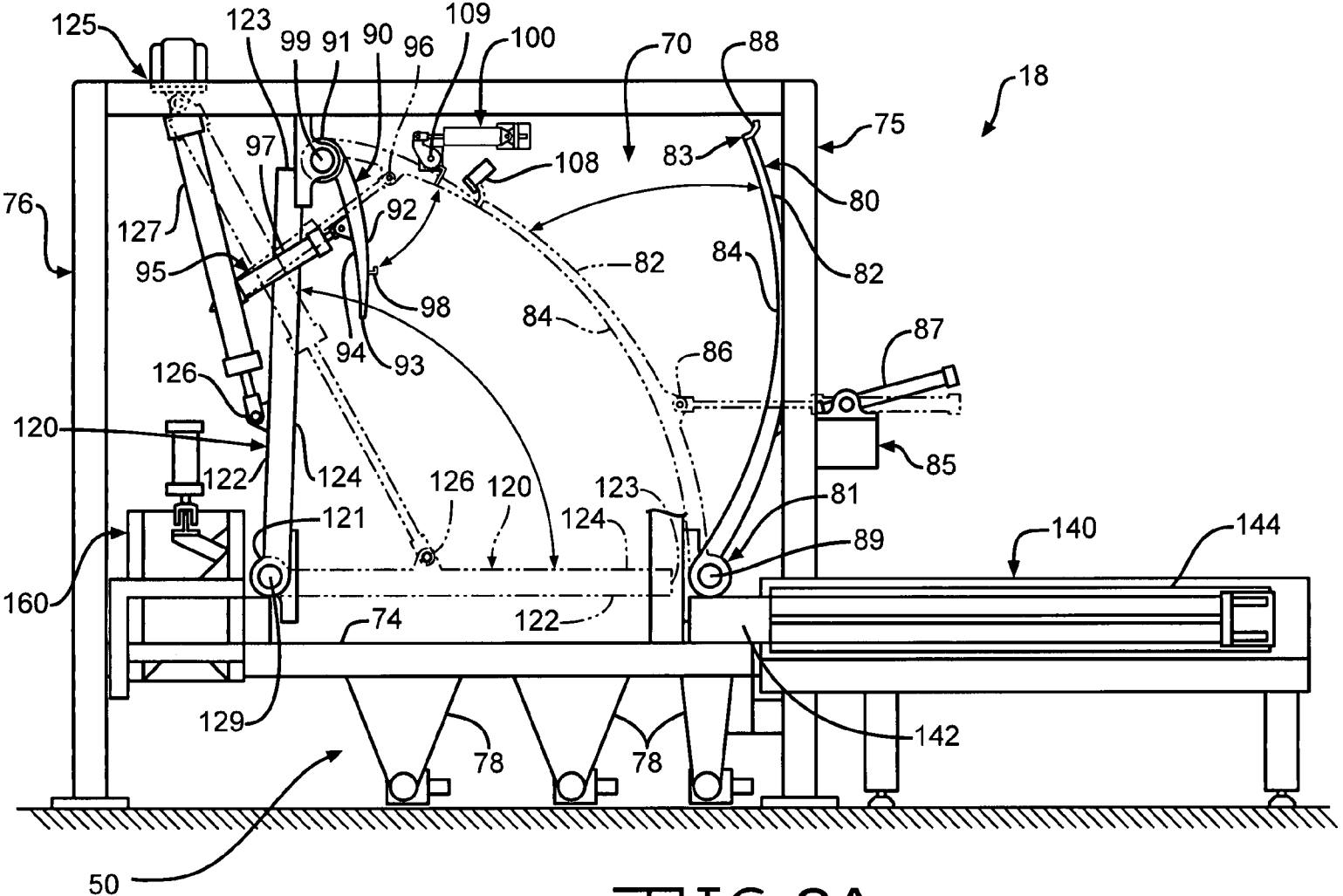
FIG. 2A is a schematic illustration showing a cross-sectional view in elevation of a compression assembly of the packaging assembly showing, in opened position, a side seal door, a top seal door, and a compression door; and showing, in phantom, the doors in closed positions.
Figure 2B:
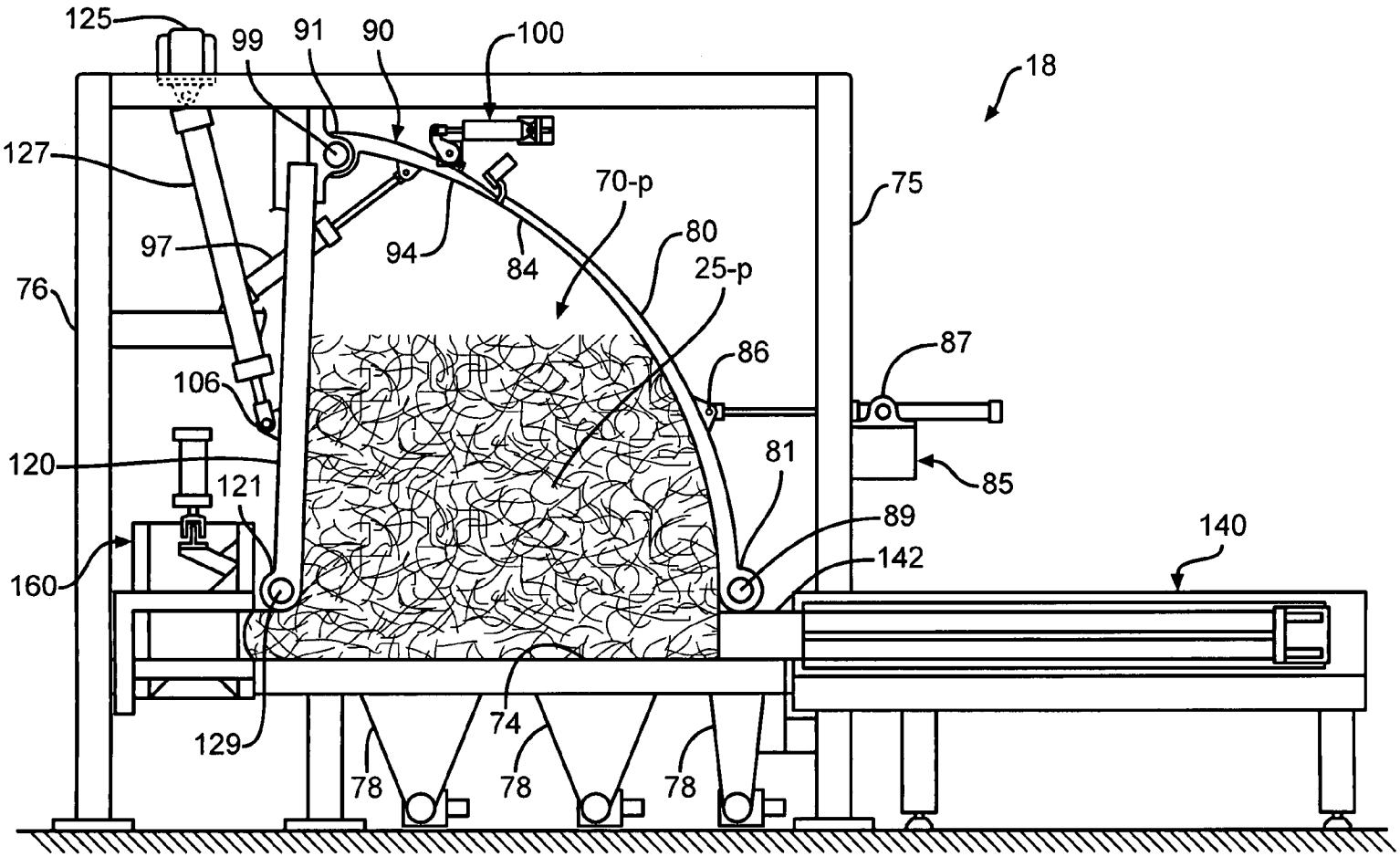
FIG. 2B is a schematic illustration, similar to FIG. 2A, showing the loose fill insulation material in the compression assembly; and, showing the side and top seal doors in closed positions, and the compression door in the opened position.
Figure 2C:
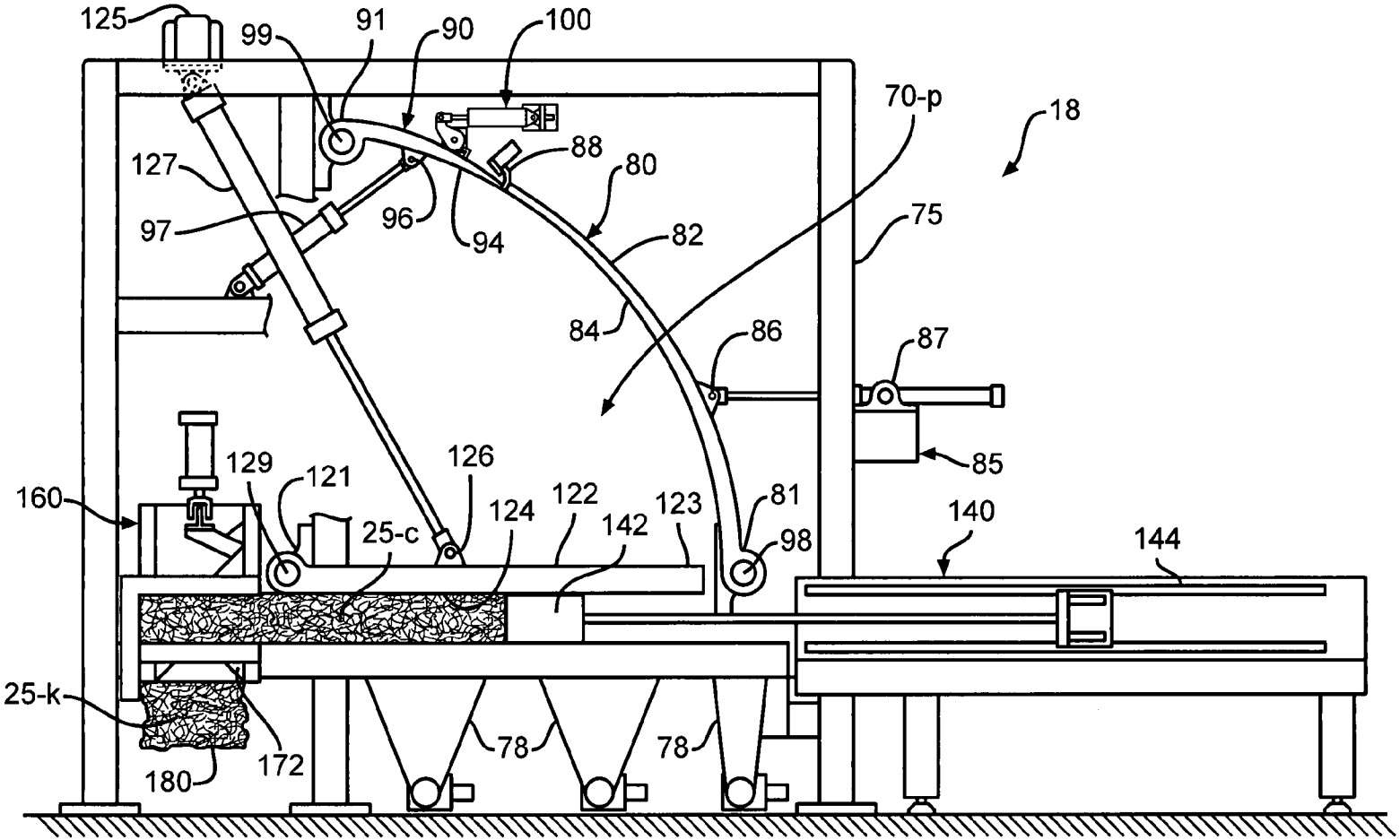
FIG. 2C is a schematic illustration, similar to FIG. 2B, showing the side and top seal doors and the compression door in closed positions, and a ramming assembly in a partially extended position.

Referring now in particular to FIG. 1A along with FIGS. 2A-2C, the compression assembly 18 defines a compression chamber 70 that has an upper opening 72, a perforated bottom wall 74, and opposing first and second sidewalls 75 and 76, respectively. The compression chamber 70 also has opposing third and fourth side walls 77 and 78, respectively, as best seen in FIG. 1B.

In the embodiment shown, the single air-withdrawing source 50 for withdrawing air from the packaging assembly 10 is positioned beneath the perforated compression chamber bottom wall 74 to draw air in a vertically downward direction through the packaging assembly 10. The amount, speed and/or negative, or suction, air pressure can be adjusted so that the air-withdrawing source 50 can be run intermittently, or continuously. The source 50 is connected to a suction blower, not shown.

The air (as generally shown in FIG. 1A by arrows "a") is drawn down through the surge hopper assembly 14, the weigh hopper assembly 16, and through the compression assembly 18. The walls of the surge hopper assembly 14 and the weigh hopper assembly 16 are configured so that there is only one place, the source 50, were air can be withdrawn from the packaging assembly 12. The drawn air pulls the insulation materials against the surge hopper doors 44, and holds (or applies a downward suction force on) the insulation surge hopper body 25-*s*. Likewise, when the insulation materials are dispersed into the weigh hopper assembly 16, the drawn air pulls the insulation materials against the weigh hopper doors 64, and holds (or applies a downward force on) the weigh hopper body 25-*w*.

Finally, when the insulation materials are then dispersed into the compression assembly 18, the drawn air pulls the insulation materials 25 down onto the perforated bottom wall 74. The drawing of air from the compression assembly 18 during the discharge of the weigh hopper body 25-*w* into the compression assembly 18 reduces the "boiling" or upward scattering of the insulation materials 25 back up into the weigh hopper assembly 16.

The reduction in the scattering of the insulation materials 25 in the weigh hopper assembly 16 and in the compression assembly 18 allows both the weigh hopper assembly 16 and the compression assembly 18 to be manufactured with more efficient, and shorter, height dimensions, as compared to prior insulation material bagging assemblies.

The flow of drawn air through the surge hopper assembly 14, the weigh hopper assembly 16 and the compression assembly 18 also collects and filters out dust and/or extraneous fibers that are generated during the packaging of the insulation materials. The dust/fibers are collected along a common downward pathway (as shown by axis Y in FIG. 1A) to the bottom wall 74 of the compression assembly 18.

The vertical dust/fibers collection also provides an improvement over prior baggers which, in the past, had needed a great many (often ten to twelve) extraneous insulation material collection points. In the past, the multiple dust collectors were set at different points along the entire height of the bagger to withdraw the dust in a horizontal direction from each processing step.

According to one aspect of the present invention, the generally downward airflow of the present packaging assembly 10 reduces the amount of extraneous dust/fibers that must be recycled from the packaging assembly 10.

Thus, not only does the air-withdrawing source 50 exert the generally downward pulling force on the surge hopper insulation material body 25-*s* and the weigh hopper insulation material body 25-*w*, the vertically drawing air additionally provides a collecting and filtering of the extraneous dust/fiber materials within the packaging assembly 10.

In the compression chamber 70, the downward drawn air pressure on the pre-compressed body 25-*p* continues as the pre-compressed insulation material body 25-*p* is compressed, as described further below. Also, the accumulating insulation material body 25-*p* acts as a filter, collecting the dust/fiber materials. Again, since there is substantially no other air flow within the bagging assembly, other than that provided by the downward drawing air, the extraneous dust/fiber materials are pulled within the insulation material body 25-*p*, rather than floating about the packaging assembly 10 or collecting in undesired locations within the packaging assembly 10.

Referring now to FIGS. 2A-2C, the compression chamber 70 includes a curved side seal door 80, a curved top seal door 90 and a compression door 120.

In certain embodiments, the side seal door 80, the top seal door 90 and the compression door 120 are perforated to allow for drawing of air through the compression chamber 70, although usually only the compression door 120 is perforated. Thus, a continuous negative air pressure continues to be exerted while the insulation material is being dispersed in a downward direction through the packaging assembly 10.

The side seal door 80 has a first end 81 pivotably mounted on a lower section of the first side 75 of the compression assembly 18. The side seal door 80 has an outer surface 82 and an inner surface 84. At least the inner surface 84 has an arcuate shape that curves in a concave direction toward the compression chamber 70. The side seal door 80 has a distal end 83 that includes a stop member 88. The side seal door 80 is operatively connected to a closing mechanism 85. In the embodiment shown, the closing mechanism 85 is pivotally mounted at a first end 86 to the outer surface 82 of the side seal door 80. In certain embodiments, the closing mechanism 85 includes an actuator assembly 87 which enables the side seal door 80 to be pivotally moved about its first end 81. In other embodiments, other configurations can be used.

Figure 3:
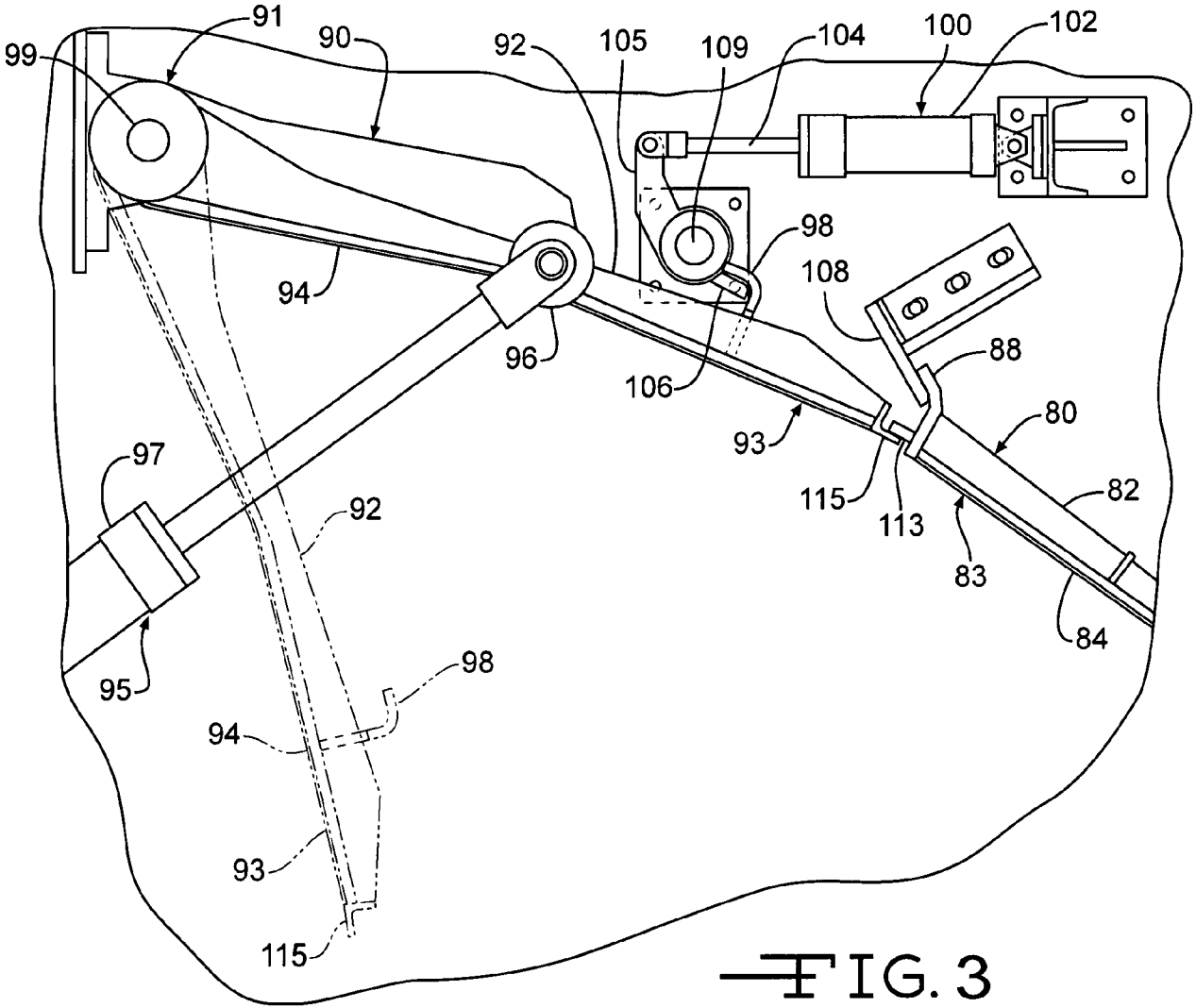
FIG. 3 is a schematic illustration showing a locking assembly holding the side and top seal doors on a closed and locked position; and, showing the top seal door, in phantom, in an opened position.

The top seal door 90 has a first end 91 pivotably mounted on an upper section of the second side 76 of the compression assembly 18. The top seal door 90 has an outer surface 92 and an inner surface 94. At least the inner surface 94 has an arcuate shape which curves in a concave direction toward the bottom wall 74 of the compression chamber 70. The top seal door 90 has a second, and opposing, distal end 93 that includes a locking member 98, as best seen in FIGS. 2B, 2C and 3. The top seal door 90 is operatively connected to a closing mechanism 95. In the embodiment shown the closing mechanism 95 is pivotally mounted at a first end 96 to the inner surface 94 of the top seal door 90. In certain embodiments, the closing mechanism 95 includes an actuator assembly 97 which enables the top seal door 90 to be pivotally moved about its first end 91. In other embodiments, other configurations can be used.

In certain embodiments, as best shown in FIG. 3, the compression assembly 18 also includes at least one locking assembly 100 that is configured to hold the top seal door 90 in a closed and locked position against the side seal door 80. In the embodiment shown, there are locking assemblies 100 mounted on both the third and fourth sides 77 and 78 of the compression chamber 70. For ease of explanation, however, only one locking mechanism 100 will be explained in detail. Also, in certain embodiments, there can be only one locking mechanism 100.

The locking assembly 100 includes an actuator 102 which operatively extends and retracts a locking piston 104. A distal end of the locking piston 104 is connected to a pivotably moving locking hub 105. An interlocking member 106 is secured to a distal end of the locking hub 105. A stop plate bracket mechanism 108 is mounted within the compression chamber 70 in a spaced apart relationship near the locking hub 105.

When the side and top seal doors 80 and 90 are pivoted to a closed position, the side and top seal distal ends 83 and 93 are brought into contact with each other. The side seal distal end 83 is pivoted in a downward arcuate direction while the top seal distal end 93 is pivoted in an upward arcuate direction, as shown in FIGS. 2C and 3. The stop member 88 on the side seal distal end 83 contacts the stop plate 108 which prevents the side seal door 80 from any further arcuate travel.

In certain embodiments, the side seal door distal end 83 can include a flange 113. Likewise, the top seal door distal end 93 can include a flange 115 which is brought into engagement with the side seal flange 113 when the side and top seal doors 80 and 90 are in a closed position.

As the side seal door 80 is pivoted downwardly and the top seal door 90 is pivoted upwardly, the locking mechanism 100 is activated to extend the locking piston 104 and thereby pivot the locking hub 105 about its axis. Thus, as the top seal door 90 is pivoted upwardly, the locking member 98 on the top seal door 90 is also pivoted upwardly. Simultaneously, as the locking hub 105 is pivoted about its axis, the interlocking member 106 is also pivoted in an upward direction to secure the locking member 98. The top seal door 90 is held in the locked position at two locations along its moment arm, i.e., at the first end 96 of the closing mechanism 90 and at the locking member 98. The engagement of the locking member 98 with the interlocking member 106 aids in providing an additional sealing of the top seal distal end 93 (and flanges 115, if present) against the side seal distal end 83 (and flange 113, if present).

In certain embodiments, the locking mechanism 100 substantially eliminates the need to solely rely on the forces applied by the side and top seal door actuators 85 and 95 to hold the side and top seal doors, 80 and 90, in a closed position. The locking mechanism 100 also allows a close tolerance to be established between the top and side seal doors, 80 and 90.

Referring again to FIGS. 2A-2C, when the side seal door 80 and the top seal door 90 are pivoted to a closed position, the inner faces 84 and 94 on the side seal and top seal doors 80 and 90 form a closed compression chamber 70-*p*, as shown in FIGS. 2B and 2C.

After the side and top seal doors 80 and 90 are closed, the compression door 120 is then closed, as shown in phantom in FIG. 2A, and as shown in FIG. 2C. The compression door 120 has a first end 121 pivotably mounted on a lower section of the second side 76 of the compression assembly 18. As shown in FIG. 2A, the compression door 120 has an outer surface 122 and an inner surface 124. At least the inner surface 124 of the compression door 120 has a straight, or planar, shape. The compression door 120 has a second, and opposing, distal end 123. The compression door 120 is operatively connected to a closing mechanism 125. In the embodiment shown, the closing mechanism 125 is pivotally mounted at a first end 126 to the outer surface 122 of the compression door 120. In certain embodiments, the closing mechanism 125 includes an actuator assembly 127 which enables the compression door 120 to be pivotally moved about its first end 121.

When the side seal door 80 and the top seal door 90 are fully extended to the closed position, they cooperate to form an arced sealing surface. When the compression door 120 is pivotably moved to a closed position, as shown in FIG. 2C, the distal end 123 of the compression door 120 is moved in an arcuate direction toward the bottom wall 74 of the compression chamber 70. The distal end 123 travels in the arcuate downward path, sweeping along the arced sealing surfaces of the closed inner faces 84 and 94 of the side and top seal doors 80 and 90.

The side seal door closing mechanism 85, the top seal door closing mechanism 95, and the locking mechanism 100 hold the side and top seal doors 80 and 90 in a secure position. The locking mechanism 100 thus allows a desirably close clearance to be established between the closed side and top seal doors 80 and 90 and the compression door 120 when the compression door 120 is pivotably moved to a closed position, as shown in FIG. 2C. Since there is a close clearance between the opening 72 and the locked side and top seal doors 80 and 90 the compression assembly 18 has reduced height requirements.

The locking mechanism 100 provides sufficient rigidity to the cooperating side seal door 80 and the top seal door 90 to substantially eliminate the insulation material from passing between the distal end 123 of the compression door 120 and the arced sealing surface during the pivoting of the compression door 120.

In certain embodiments, one or more of the side seal door 80, the top seal door 90, the locking mechanism 100, and/or the compression door 120 are pivotably mounted using bearing mechanisms 89, 99, 109 and/or 129, respectively. The bearing mechanisms 89, 99, 109 and/or 129 reduce or prevent excessive wear caused by the rapid, and repeated, openings and closings of the side seal door 80, the top seal door 90, the locking mechanism 100, and/or the compression door 120. The bearing mechanisms 89, 99, 109 and/or 129 are mounted externally to the compression chamber 70 so that they can be easily monitored for any undesired fiber build-up. In such embodiments, the use of such bearing mechanisms 89, 99, 109 and/or 129 eliminates the need for hinges within the compression assembly 18. In the past, substantially catastrophic failures occasionally occurred when hinges were contaminated with loose fibers. Also, since at least a portion of the hinge was exposed to insulation materials inside the compression chamber, the hinge could not be readily monitored for undesired fiber build-up within the hinge.

Also, with the elimination of hinges, there is little or no wear within the pivoting ends 81, 91 and/or 121 of the doors 80, 90 and/or 120, respectively. In the past, the wearing on pivot ends also often caused a change in the alignment and clearances among the doors. Since wear was known and expected to occur in the prior baggers, such baggers were made with sufficiently large tolerances in order to accommodate for such eventual and expected wear. Also, in the past, the changes in alignments and clearances between the doors also caused the fibers to collect along the hinge pivot points, causing still further changes in clearances and alignment of the doors.

In the present invention, since the compression assembly 18 provides a close alignment of each of the side seal door 80, the top seal door 90 and the compression door 120, the height requirements of the compression chamber 70 are further reduced.

Referring now to FIG. 1A along with FIGS. 2A-2C, the compression assembly 18 is shown as receiving the weigh hopper insulation material body 25-*w*. The weigh hopper insulation material body 25-*w* is dispersed and falls or accumulates into another low-profile body, shown as a pre-compressed body 25-*p*. The side seal door 80 and the top seal door 90 are then pivotally closed, as explained above. The compression door 120 is then pivotably moved to the closed, or horizontal, position adjacent to the bottom wall 74 of the compression chamber 70. Thus, the closed compression door 120 and the perforated bottom wall 74 define a ramming chamber 130.

As seen by referring to both FIGS. 2B and 2C, the compression door 120 contacts and then compresses the pre-compressed insulation material body 25-*p* on the bottom wall 74 of the compression assembly 18 to form a compressed insulation material body 25-*c* within the ramming chamber 130.

The generally level or low-profile height dimension of the pre-compressed body 25-*p* thus provides a substantially even distribution of insulation materials within the compressed body 25-*c*. Also, the negative air pressure being applied by the air drawing source 50 through the bottom wall 74 aids in pulling the pre-compressed body 25-*p* against the bottom wall 74 as the pre-compressed body 25-*p* is formed into the compressed body 25-*c* within the ramming chamber 130.

The ramming chamber 130 is in a horizontal alignment with a ramming assembly 140. The compression door 120 remains in the closed position while the ramming assembly 140 is engaged, as shown in FIG. 2C, and is extended into the ramming chamber 130. The ramming assembly 140 includes a ram 142 having a ram head 145 which is fully extended from and retracted into a guiding system 144. The ramming assembly 140 also eliminates the need for rack and pinion guiding systems, or other rigorous guiding systems.

In certain embodiments, the ramming assembly 140 also reduces ram failures and/or twisting of the ram during its travel, which often occurred with the previously used compression rams. The ramming assembly 140 can also withstand greater compression loads than previous systems. The ram head 145 has a leading face 146 and a rear face 147 that are spaced apart at a distance "b", as shown in FIG. 2A. The ramming chamber 130 (as defined by the perforated bottom wall 74 and the compression door 120 when the compression door 120 is pivotably moved to the closed position) has a distance, or height, "c", also as shown in FIG. 2A. The distance "b" between the leading and rear faces 146 and 147 is at least as long as the distance, or height, "c" between the perforated bottom wall 74 and the closed compression door 120. In some embodiments, the distance "b" has a length that is at lest 1.2 times the height "c".

The distance "b" between the front and rear faces 146 and 147 also provides the ram head 145 with additional stability and less undesirable torquing or twisting movement as the ram 142 is extended and retracted in the ramming chamber 130. The ram head 145 provides a desired greater surface contact along the edge of the travel within the ramming chamber 130, thus distributing the compressive load on the insulation material body 25-*c* more uniformly. This more even distribution of compressive loads by the ram head 145 on the insulation material also reduces the wear, maintenance and/or replacement costs of the ram 142 and the guiding system 144.

The ramming assembly 140 substantially eliminates operating failures which might stem from insulation material build-up between the ram 142 and the bottom wall 74 of the compression chamber 70.

In the packaging assembly 10, the ram 142 travels in a horizontal orientation, rather than a vertical orientation. The horizontal orientation of the ram 142 reduces, or eliminates, the problems that had previously occurred with the prior bagger systems' vertical compression of insulation materials. In the past, the extraneous dust/fibers would collect on a top face of a vertically traveling ram, and an undesirable build-up of insulation materials would form between the vertical ram and the top of its housing. In the past, this vertical fiber build-up also resulted in system failures since the dust/fibers materials restricted, or prevented, the vertically traveling ram from making a complete up-and-down cycle.

According to this embodiment of the present invention, when the ram 142 is retracted in the horizontal direction, any insulation material that might collect behind the ram head 145 then is pushed by the rear face 147 into contact with the perforated bottom wall 74 of the compression chamber 70. The air-withdrawing source 50 then removes any loose fibers, thereby maintaining the ram 142 is a clean condition. this reduced maintenance required to clean out fiber build up.

Referring again in particular to FIGS. 1B and 2C, as the ram 142 is extended, the compressed body 25-*c* is further compressed into a compressed package 25-*k* of insulation material 25. The compressed package 25-*k* is moved by the ram 142 into alignment with a bagging assembly 160, as best shown in the plan view in FIG. 2B. The bagging assembly 160 generally includes a discharge door 162, a discharge ram 165, and a bagging device 170. The horizontal orientation of the bagging assembly 160 also reduces the height requirements of the packaging assembly 10.

The bagging device 170 includes a snout 172 which has a bag 180 positioned over the snout 172. The discharge ram 165 is extended to push the package 25-*p* horizontally along the snout 172 and into the bag 180. The discharged packaged 25-*k* substantially fills the bag 180 and pushes the bag 180 off the snout 172 and onto a conveyor (not shown) for weigh-checking and sealing. In certain embodiments, during the bagging operation, opposing sidewalls of the snout 172 are collapsed to allow another bag to be positioned on the end thereof.

The horizontal orientation of the bagging assembly 160 and the snout 172 also allows the bag 180 to be easily positioned on, and remain secured to, the snout 172. Often, different bags have slightly different circumferential sizes due to manufacturing tolerances. The snout 172 is expanded against the interior of the bag 180 by the package 25-*k* while the package 25-*k* is being ejected into the bag 180. In certain embodiments, the bagging device 170 includes a pressure controller 174 which senses pressure of the snout 172 against the inner circumference of the bag 180. The pressure sensor 174 eliminates the previous practice where the bags were often held on the snout with clamps, cranks, and/or manual hand pressure.

During an initial operation of the packaging assembly 10, the surge hopper doors 44 are open to allow the insulation material 25 to be dispersed directly into the weigh hopper assembly 16 and accumulate as the weigh hopper insulation material 25-*w*. The surge hopper doors 44 are then closed when a desired weight of insulation material within the weigh chamber 60 is reached.

The closed surge hopper doors 44 allow additional surge hopper insulation material 25-*s* to accumulate in the surge hopper chamber 40. Meanwhile, the weigh hopper doors 64 are open and dispensing the insulation material body 25-*w* into the compression chamber 70. The insulation material 25 then re-accumulates as the pre-compressed insulation material body 25-*p*. The weigh hopper doors 64 are then closed, and the surge hopper doors 44 are again opened to refill the weigh hopper chamber 60.

When the pre-compressed insulation material body 25-*p* has been accumulated in the compression chamber 70, the side seal door 80 closes, partially compressing the insulation material 25-*p*. The top seal door 90 also closes, thus forming the closed compression chamber 70-*p*. The locking mechanism 100 is engaged and both the side and top seal doors 80 and 90 are then locked into the arcuate configuration. The compression door 120 is then pivotably closed, following the arcuate configuration of the side and top seal doors 80 and 90, thereby forming the ramming chamber 130.

The compression door 120 compresses the compressed insulation material 25-*p* against the perforated bottom wall 74 into a rectangular-shaped compressed insulation material body 25-*c* within the ramming chamber 130. The ramming assembly 140 then extends the ram 142 so that the ram head 145 further compresses, or compacts, the compressed insulation material body 25-*c* into a smaller, rectangular-shaped, compressed package 25-*k*, ready for bagging and discharge.

The discharge door 162 is then opened and the discharge ram 165 pushes the package 25-*k* into the bagging device 170, out the snout 172 and into the bag 180. The ram 142 and the discharge ram 165 are retracted while the weigh hopper doors 64 are in a closed position so that little or no build-up of insulation material occurs behind the ram head 145.

As can be seen by referring to both FIGS. 1A and FIG. 2B, the insulation materials 25 is dispersed and then compressed in a vertical direction along a Y axis. The compressed insulation material is then compacted along an X axis. Thereafter, the compacted package 25-*k* is moved and packaged along a Z axis. The Y and Z axes thus define the horizontal planar orientation of the ramming and bagging assemblies 140 and 160, respectively.

The downward vertical dispensing of the insulation material is aided by the drawing air supplied by the air-withdrawing source 50. The negative, or drawn, pressure exerts a generally downward vertical force on the bottoms of the accumulating insulation material bodies 25-*s*, 25-*w*, 25-*p* and 25-*c*, thereby aiding in the leveling, or evening out, of the profile height of the insulation material bodies 25-*s*, 25-*w*, 25-*p* and 25-*c*. Also, the downward vertical force at least partially aids in compressing the insulation material into the accumulating insulation material bodies 25-*s*, 25-*w*, 25-*p* and 25-*c* within the packaging assembly 10. Since the insulation material bodies 25-*s*, 25-*w*, 25-*p* and 25-*c* are at least somewhat compressed and/or held in the desired low-profile manner, the height dimensions needed for the packaging assembly 10 do not need to be as great as in prior baggers While the invention has been described with reference to specific embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments for carrying out this invention, but that the invention will include all embodiments falling within the scope of the claims.

What is claimed is:

1. A packaging assembly suitable for loosefil fibrous insulation material comprising:

a compression chamber having opposing first and second sides and a perforated bottom wall, the compression chamber configured to receive and compress the insulation material;

a side seal door pivotably mounted on the first side of the compression chamber;

a top seal door pivotably mounted on the second side of the compression chamber;

wherein the side seal door and the top seal door, when fully extended to a closed position, cooperate to form an arced sealing surface; and further including a perforated compression door pivotably mounted in the compression chamber so that during pivoting a distal end moves in an arcuate manner toward the bottom wall of the compression chamber with the distal end sweeping along the arced sealing surface.

2. The packaging assembly of claim 1 in which the bottom wall is perforated.

3. The packaging assembly of claim 2 including an air drawing assembly positioned beneath the bottom wall and configured to draw air though the packaging assembly.

4. The packaging assembly of claim 3 in which the air drawing assembly is the sole source for withdrawing air from the packaging assembly.

5. A packaging assembly suitable for loosefil fibrous insulation material comprising:

a compression chamber having opposing first and second sides and a bottom wall, the compression chamber being configured to receive and compress the insulation material;

a curved side seal door pivotably mounted on the first side of the compression chamber;

a curved top seal door pivotably mounted on the second side of the compression chamber;

wherein the side seal door and the top seal door, when frilly extended to a closed position, cooperate to form an arced sealing surface; a compression door pivotably mounted in the compression chamber, the compression door configured so that during pivoting a distal end moves in an arcuate manner toward the bottom wall of the compression chamber with the distal end sweeping along the arced sealing surface; and a locking mechanism mounted within the compression chamber, the locking mechanism configured to hold the side and top seal doors in a locked position after the side and top seal doors are pivoted to the closed position with the locking mechanism providing sufficient rigidity to the cooperating side seal door and the top seal door to substantially eliminate the insulation material from passing between the distal end of the compression door and the arced sealing surface during the pivoting of the compression door.

6. The packaging assembly of claim 5 in which the top seal door is operatively connected to a pivotally mounted closing mechanism that includes an actuator assembly that enables the top seal door to be pivotally moved about a first end.

7. The packaging assembly of claim 5, wherein the locking mechanism includes a stop plate mechanism mounted within the compression chamber, the stop plate mechanism being configured to hold the side seal door against the top seal door when the side and top seal doors are in the locked position.

8. The packaging assembly of claim 5 in which the locking mechanism includes an actuator which operatively extends and retracts a locking piston.

9. The packaging assembly of claim 8 in which a distal end of the locking piston is connected to a pivotably moving locking hub.

10. The packaging assembly of claim 9 in which an interlocking member is secured to a distal end of the locking hub.

11. The packaging assembly of claim 10 in which the locking mechanism includes a stop plate mechanism mounted within the compression chamber, the stop plate mechanism being configured to hold the side seal door against the top seal door when the side and top seal doors are in the locked position.

12. The packaging assembly of claim 5 in which the bottom wall is perforated.

13. A packaging assembly suitable for loosefil fibrous insulation material comprising:

a compression chamber having opposing first and second sides and a bottom; the compression chamber configured to receive and compress the insulation material;

a side seal door pivotably mounted on the first side of the compression chamber;

a top seal door pivotably mounted on the second side of the compression chamber, wherein the side seal door and the top seat door, when fully extended to a closed position, cooperate to form an arced sealing surface; and a compression door pivotably mounted on the second side of the compression chamber;

wherein one or more of the side seal door, the top seal door, and the compression door are pivotably mounted with sealed bearing hinge mechanisms that are configured to substantially prevent extraneous fibers or dust material from being collected within the sealed bearing hinge mechanisms.

14. The packaging assembly of claim 13 in which each one of the side seal door, the top seal door, and the compression door is pivotably mounted with a sealed bearing hinge mechanism.

15. A packaging assembly suitable for loosefil fibrous insulation material comprising:

a compression chamber having a perforated bottom wall and a pivotably mounted compression door, the compression chamber configured to receive and compress the insulation material, and the compression door mounted to pivot toward the bottom wall to a closed position to compress the insulation material;

a side seal door pivotally mounted on the first side of the compression chamber;

a top seal door pivotally mounted on the second side of the compression chamber wherein the side seal door and the to seal door when fully extended to a closed position, cooperate to form an arced sealing surface;

a ramming chamber defined by the perforated bottom wall and the compression door when the compression door is pivotably moved to the closed position; and a ram configured to move between an extended and retracted position in the ramming chamber for compressing the insulation material, the ram having a leading face and a rear face, wherein a distance between the leading and rear faces is at least as long as a distance between the perforated bottom wall and the closed compression door defining the ramming chamber.

16. The packaging assembly of claim 15 including an air drawing assembly positioned beneath the bottom wall and configured to draw air through the packaging assembly.

17. The packaging assembly of claim 16 in which the air drawing assembly is the sole source for withdrawing air from the packaging assembly.

18. The packaging assembly of claim 17 in which the compression door is pivotably mounted with a sealed bearing hinge mechanism that is configured to substantially prevent extraneous fibers or dust material from being collected within the sealed bearing hinge mechanisms.

19. The packaging assembly of claim 15 in which the ram is configured to move horizontally.

20. The packaging assembly of claim 15 in which the compression door is pivotably mounted with a sealed bearing hinge mechanism that is configured to substantially prevent extraneous fibers or dust material from being collected within the sealed bearing hinge mechanisms, and in which the ram is configured to move horizontally.

* * * * *